US012098495B2

(12) United States Patent
Ford et al.

(10) Patent No.: US 12,098,495 B2
(45) Date of Patent: Sep. 24, 2024

(54) MECHANISM FOR ARTICULATING WASHING MACHINE APPLIANCES

(71) Applicant: Haier US Appliance Solutions, Inc., Wilmington, DE (US)

(72) Inventors: James Augustine Ford, Fisherville, KY (US); Stephen Edward Hettinger, Louisville, KY (US); Jason Meurer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 207 days.

(21) Appl. No.: 17/750,762

(22) Filed: May 23, 2022

(65) Prior Publication Data

US 2023/0374718 A1 Nov. 23, 2023

(51) Int. Cl.
*D06F 39/12* (2006.01)

(52) U.S. Cl.
CPC ..... *D06F 39/125* (2013.01)

(58) Field of Classification Search
CPC ..... D06F 39/12; D06F 39/125; D06F 37/26
See application file for complete search history.

(56) References Cited

U.S. PATENT DOCUMENTS 2,649,699 A * 8/1953 Minor ..... F25D 11/00 62/499
4,526,020 A 7/1985 Fey et al.
4,535,610 A * 8/1985 Fey ..... D06F 29/00 68/210
5,090,220 A * 2/1992 Fukuzawa ..... D06F 23/00 68/210
6,363,756 B1 * 4/2002 Seagar ..... D06F 37/10 68/210
6,978,505 B1 * 12/2005 McIllwain ..... D06F 35/006 8/159
2015/0122967 A1 * 5/2015 Kim ..... D06F 33/30 248/550
2015/0184327 A1 * 7/2015 Kim ..... D06F 39/12 68/210

FOREIGN PATENT DOCUMENTS

| | | | |
|---|---|---|---|
| CN | 111850999 | A | 10/2020 |
| EP | 3670734 | A1 | 6/2020 |
| JP | H09182897 | A | 7/1997 |
| JP | 2015062627 | A | 4/2015 |
| WO | WO2007108311 | A1 | 9/2007 |
| WO | WO2016147554 | A1 | 9/2016 |

* cited by examiner

*Primary Examiner* — James O Hansen
(74) *Attorney, Agent, or Firm* — Dority & Manning, P.A.

(57) ABSTRACT

A washing machine appliance has a vertical direction, a transverse direction, and a lateral direction and includes a cabinet and a stand assembly. The cabinet defines an opening. The stand assembly supports the cabinet and facilitates movement of the cabinet between a loading position and a washing position. The stand assembly includes a stand defining a guide track, a plurality of linkage arms located within the stand, and a plurality of follower pins. The follower pins may be mechanically coupled to the cabinet and slidably received into the guide track to facilitate movement of the cabinet between the loading position and the washing position.

20 Claims, 6 Drawing Sheets

MECHANISM FOR ARTICULATING WASHING MACHINE APPLIANCES

FIELD OF THE INVENTION

The present subject matter relates generally to household appliances, and more particularly to washing machine appliances.

BACKGROUND OF THE INVENTION

Top load washing machines generally have a cabinet, a tub within the cabinet, and a wash basket rotatable about an axis within the tub. Entrance to the wash basket within the cabinet is generally obtained by a door located on a top panel of the cabinet of the washing machine. Articles for washing may be added or removed from the washing machine (e.g., the wash basket) by use of the door. Articles are generally washed within the wash basket, and wash fluids may be drained out of the washing machine during a wash cycle using a drain pipe connected to the tub that may extend through the cabinet and may attach to exterior draining systems (e.g., a household drain).

Larger wash tub sizes may be desirable to wash more articles in one cycle. As the capacity of top-load washers increase, the required geometry of the wash basket must either become wider or taller. A wash tub with a larger width may be undesirable for household use due to space restrictions within a household. A wash tub with a larger height may be undesirable due to accessibility issues. An increase in the height of top load washing machines may increase the difficulty for people to reach the bottom of the wash basket when unloading articles therefrom. People with a shorter stature may find it especially difficult to access the bottom of a tall wash tub, or may require assistance, for example, such as a stool, in order to do so. Thus, height or depth limitations to household washing machines may result in smaller tub sizes and reduced wash capacities.

Accordingly, a top load washing machine appliance having improved accessibility would be useful. Additionally or alternatively, a washing machine appliance that is top loading, has a large capacity, and is usable by most users without assistance would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may have a vertical direction, a transverse direction, and a lateral direction. The washing machine may include a cabinet defining an opening and a stand assembly supporting the cabinet. The cabinet may be moveable between a loading position and a washing position. The stand assembly may include a stand defining a guide track, a plurality of linkage arms located within the stand, and a plurality of follower pins pivotably connecting the linkage arms. The follower pins may be mechanically coupled to the cabinet and slidably received into the guide track to move the cabinet between the loading position and the washing position.

In another exemplary aspect of the present disclosure, an articulating stand assembly for supporting a washing machine appliance is provided. The washing machine may include a cabinet. The washing machine may include a vertical direction, a transverse direction, and a lateral direction. The stand assembly may include a stand defining a guide track, a plurality of linkage arms located within the stand, and a plurality of follower pins pivotably connecting the linkage arms. The plurality of linkage arms may be configured to mechanically couple to the washing machine. The plurality of follower pins may be slidably received into the guide track to move between a loading position and a washing position.

In another exemplary aspect of the present disclosure, a washing machine appliance is provided. The washing machine appliance may have a vertical direction, a transverse direction, and a lateral direction. The washing machine may include a cabinet and a stand assembly. The cabinet may have a base, a top, and may define an opening at the top. The stand assembly may be located below the base. The stand assembly may include a stand having two opposing sides, and a plurality of follower pins. At least one of the opposing sides may define a guide track. The plurality of follower pins may be moveable within the guide track to move the appliance between a loading position and a washing position. The top of the cabinet may be rotated by an angle with the vertical direction in the loading position. The top of the cabinet may extend in a plane substantially parallel to the transverse direction in the washing position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same of similar reference numerals in the figures denotes the same or similar features unless the context indicates otherwise.

DETAILED DESCRIPTION

Figure 1:
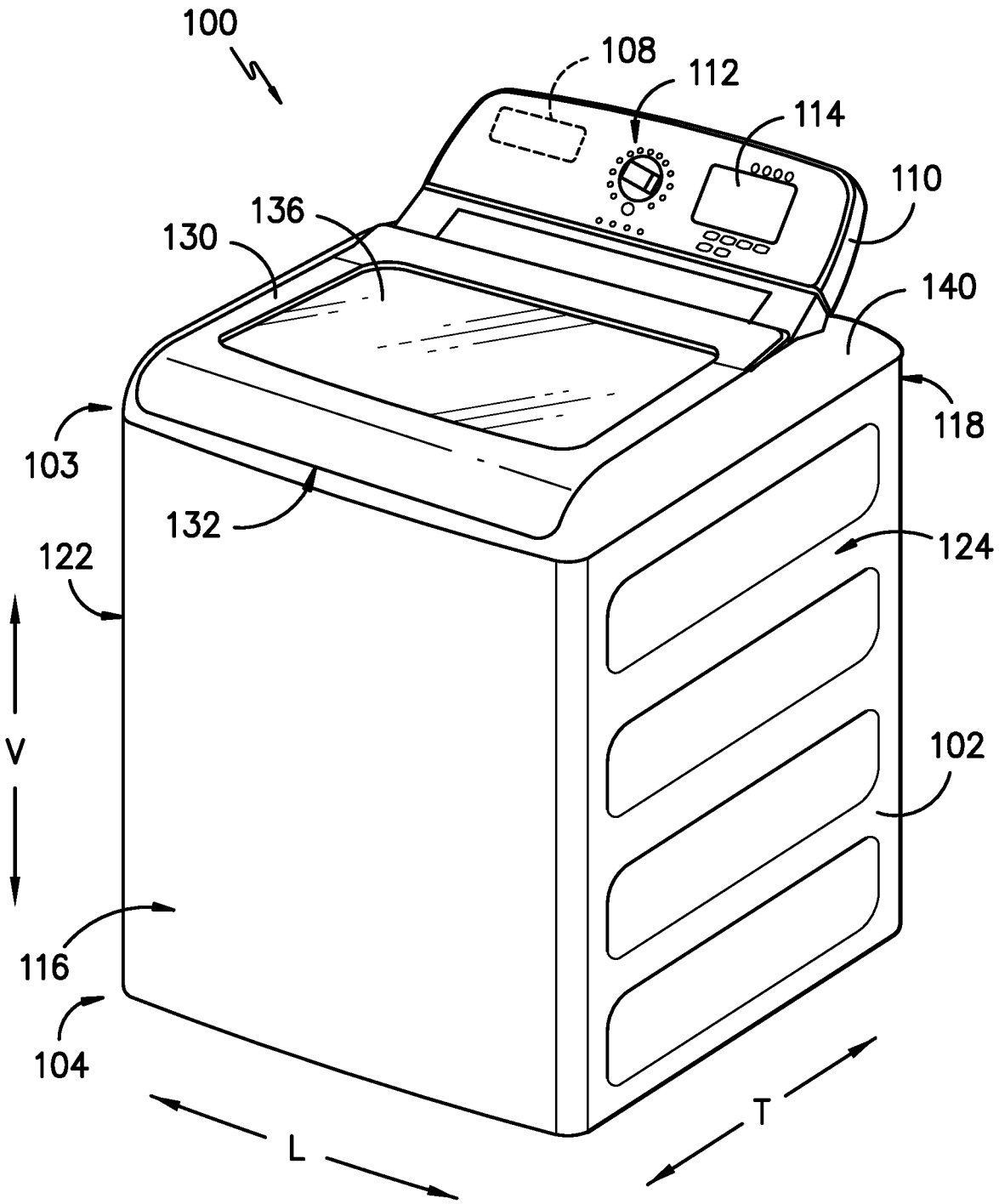
FIG. 1 provides a perspective view of a top load washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Terms such as "inner" and "outer" refer to relative directions with respect to the interior and exterior of the washing machine appliance, and in particular the chamber(s) defined therein. For example, "inner" or "inward" refers to the direction towards the interior of the washing machine appliance. Terms such as "left," "right," "front," "back," "top," or "bottom" are used with reference to the perspective of a user accessing the appliance (e.g., when the door is in the closed position). For example, a user stands in front of the appliance to open a door and reaches into the internal chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as clockwise or counterclockwise, with the vertical direction V).

The present invention advantageously provides a washing machine appliance that may provide improved access to a wash basket of a washing machine appliance. A stand tilts the washing machine at an angle. Advantageously, embodiments described herein may allow for increased height in washing machines without decreasing accessibility to wash baskets enclosed therein. Larger capacity washing machine appliances may further be possible due to the increased accessibility created by embodiments of the present disclosure.

Figure 2:
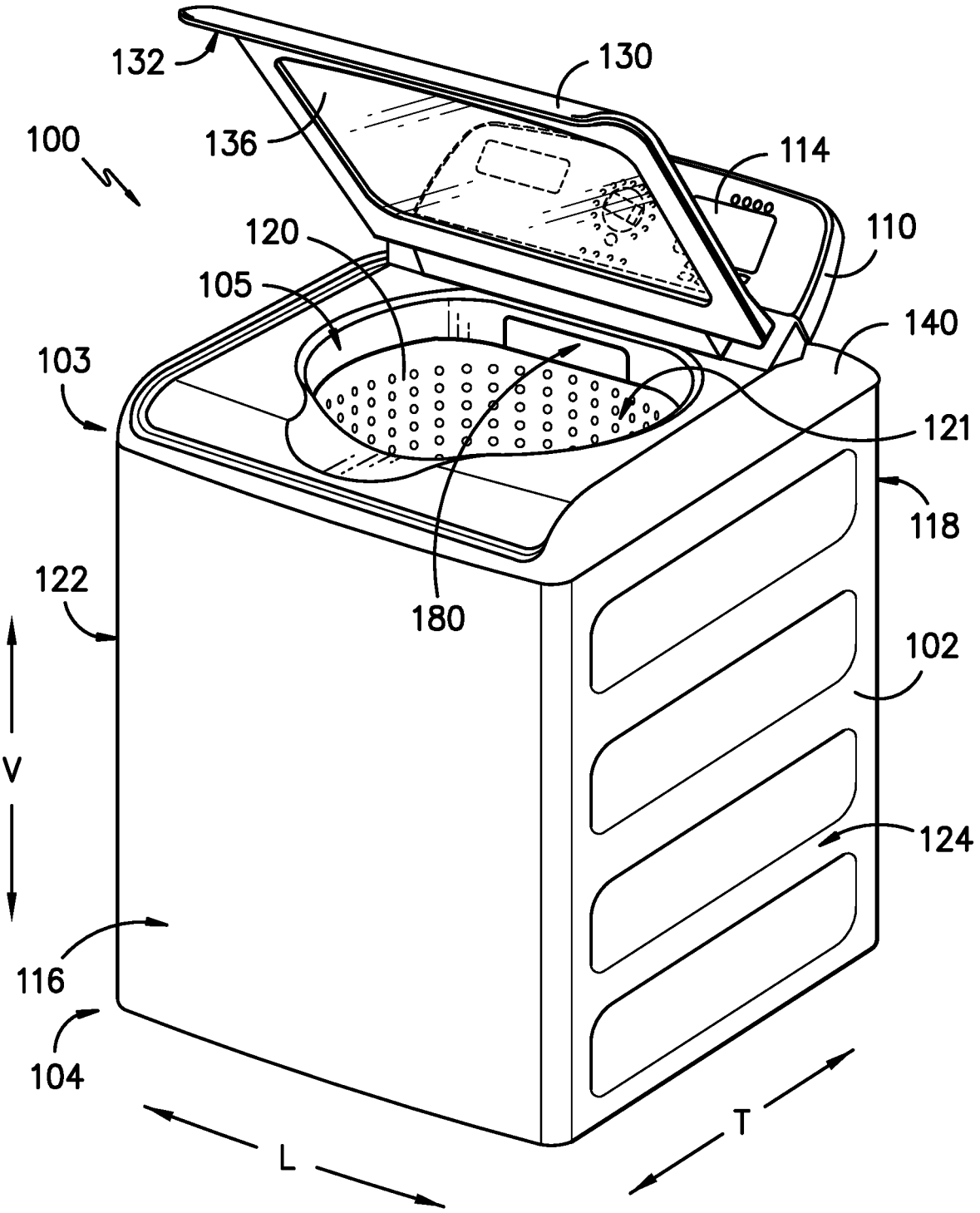
FIG. 2 provides a perspective view of the exemplary washing machine appliance of FIG. 1 in an open position according to exemplary embodiments of the present disclosure.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines).

Washing machine appliance 100 has a cabinet 102 that extends between a top portion 103 and a bottom portion 104 along the vertical direction V. A wash basket 120 is rotatably mounted within cabinet 102. A motor (e.g., motor 142 in FIG. 5) may be in mechanical communication with wash basket 120 to selectively rotate wash basket 120 (e.g., about a rotation axis during an agitation or a rinse cycle of washing machine appliance 100). Wash basket 120 is received within a wash tub 121 and is configured for receipt of articles for washing. The wash tub 121 holds wash and rinse fluids for agitation in wash basket 120 within wash tub 121. In optional embodiments, an agitator or impeller (not shown) extends into wash basket 120 and is also in mechanical communication with the motor. The impeller may assist agitation of articles disposed within wash basket 120 during operation of washing machine appliance 100.

Figure 3:
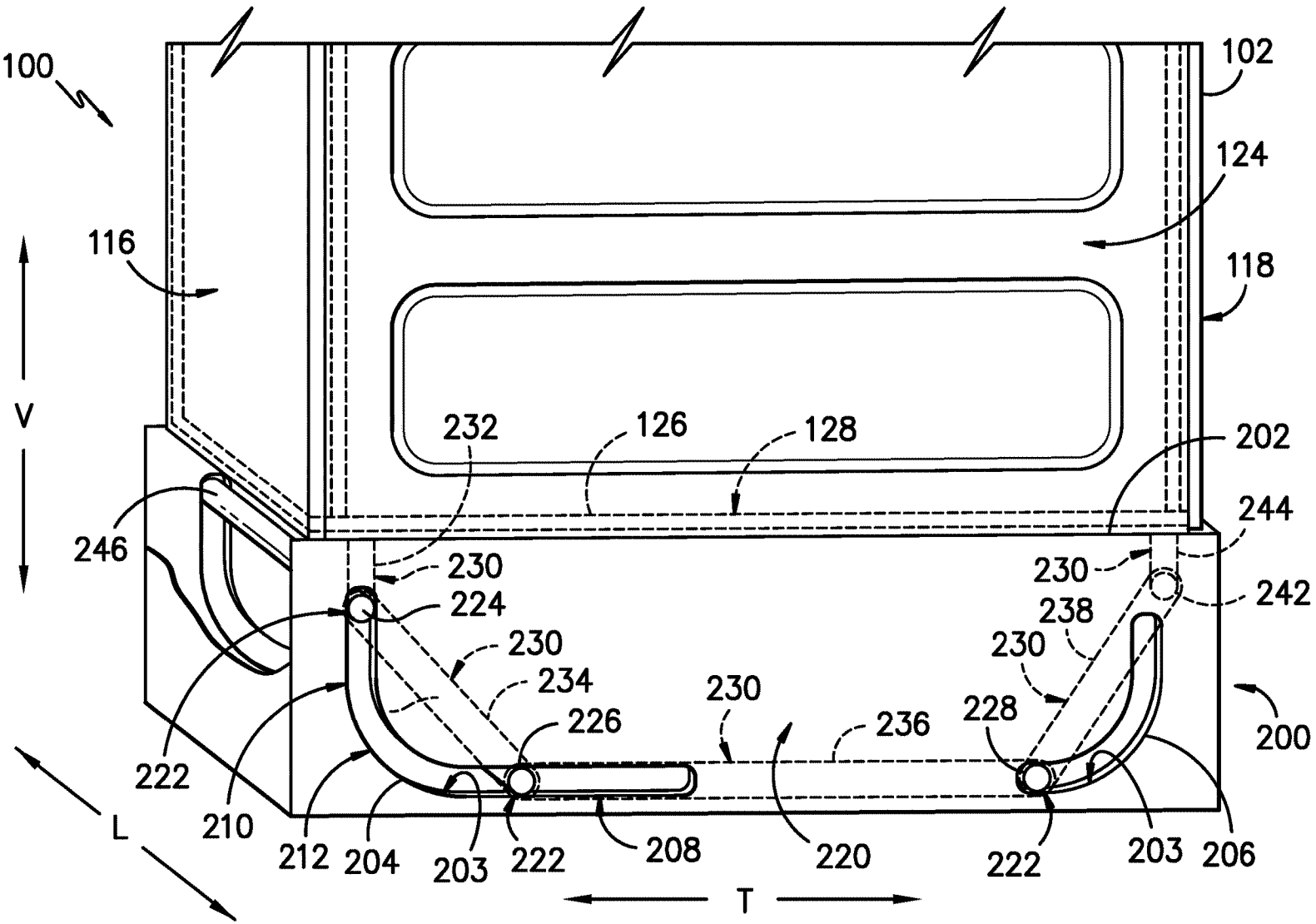
FIG. 3 provides a perspective, side view of an exemplary washing machine appliance in a washing position according to exemplary embodiments of the present disclosure.
Figure 4:
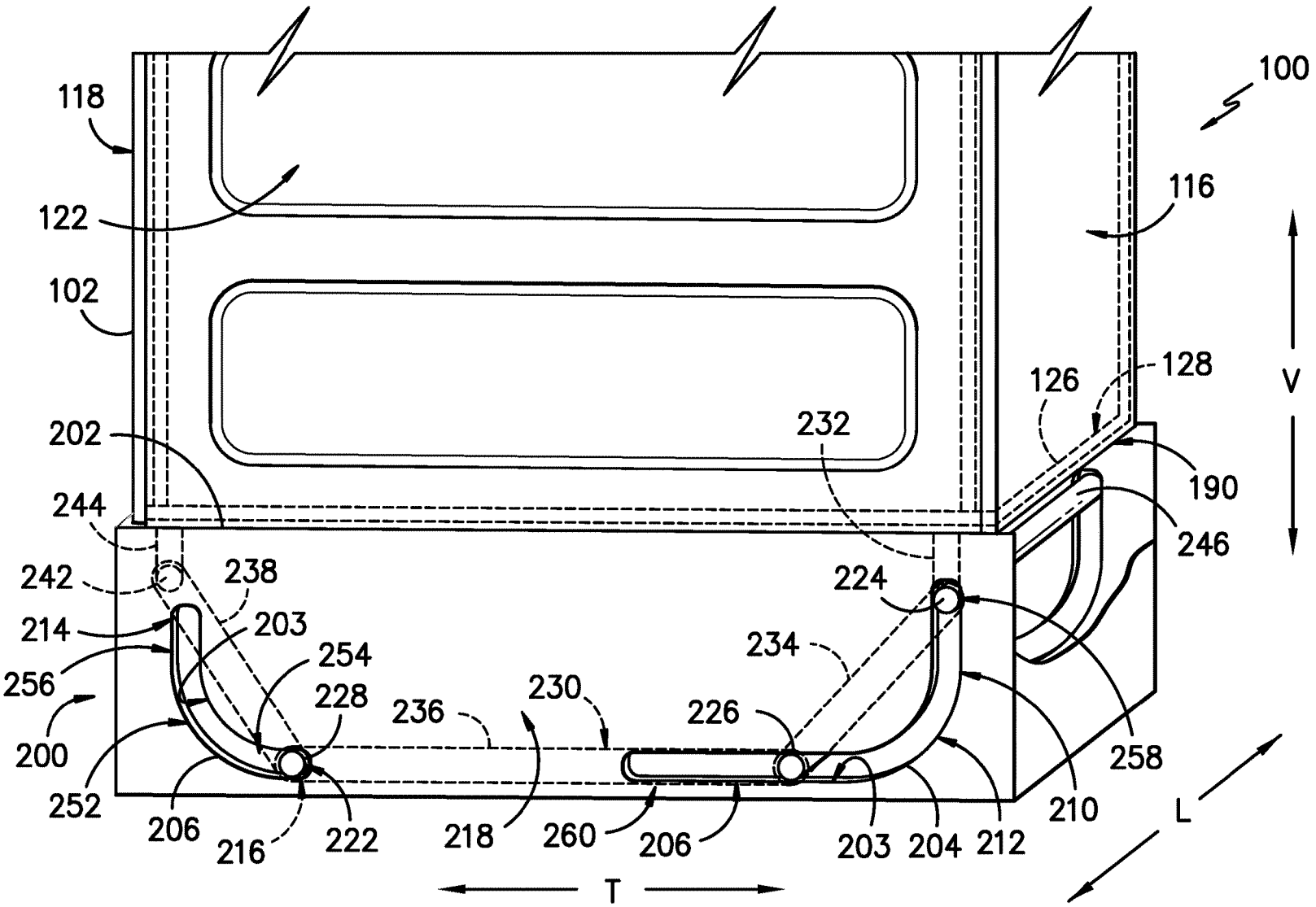
FIG. 4 provides an alternate perspective, side view of the exemplary washing machine appliance of FIG. 3 in the washing position according to exemplary embodiments of the present disclosure.

Cabinet 102 of washing machine appliance 100 may have a front panel 116, a rear panel 118, a left panel 122, and a right panel 124. Washing machine appliance 100 may further include a frame (e.g., frame 126 in FIGS. 3 and 4). In some embodiments, cabinet 102 may further surround the frame. The frame may support structures, including the cabinet 102, articles, or fluids placed inside cabinet 102 during machine cycles. The frame may include a base frame member (e.g., base frame 128 as shown in FIGS. 3 and 4), extending along a plane with lateral direction L and transverse direction T. Though shown as a frame with a base frame member in FIGS. 3 and 4, in some embodiments, the frame may include a rigid base, omitting side members extending in vertical direction V, or another supporting frame structure, as would be understood.

In some embodiments, cabinet 102 of washing machine appliance 100 has a top panel 140. Top panel 140 defines an opening 105 that permits user access to wash basket 120 of wash tub 121. Door 130, which may be rotatably mounted to top panel 140, permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a selected machine cycles and features (e.g., as part of a washing operation). The memory may represent random access memory such as DRAM or read only memory such as ROM or FLASH. In certain embodiments, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 (e.g., one or more sensors, such as a pressure sensor mounted to tub 121) may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 or wash tub 121 is filled with water and detergent or other fluid additives via an additive dispenser 180. One or more valves can be controlled by washing machine appliance 100 to provide for filling wash basket 120 to the appropriate level for the volume or number of articles being washed or rinsed. By way of example for a wash cycle, once wash tub 121 is properly filled with fluid, the contents of wash tub 121 can be agitated (e.g., with an impeller as discussed previously) for washing of laundry items in wash basket 120.

After the agitation phase of the wash cycle is completed, wash tub 121 can be drained. Laundry articles can then be rinsed (e.g., for a rinse cycle) by again adding fluid to wash basket 120 depending on the specifics of the washing operation selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Aspects of the present subject matter are directed to a mechanism to increase accessibility to a washing machine appliance. Accessibility may be a key concern in larger washing machine appliances. In some embodiments, a top load washing machine may be particularly improved by embodiments described herein. People may find it difficult to reach into a top load washing machine appliance to reach a bottom of the appliance's wash basket, for example, to empty articles that have been washed. Such difficulty may increase with taller washing machines with larger capacities. Advantageously, embodiments described herein may allow for increased access into wash baskets of washing machine appliances, including top load washing machine appliances, by adjusting the position of the opening to the cabinet of the appliance. Some embodiments described herein may further rotate the washing machine appliance, angling the appliance downward with respect to the vertical direction V, allowing the opening or top panel of the cabinet of the washing machine to be lowered relative to the position of the washing machine prior to rotation. In some embodiments, the center of gravity or center of mass of the washing machine appliance may be maintained over the base of the machine, allowing for a stable rotation of the appliance, increasing accessibility to the wash basket, and maintaining stability of the appliance.

Figure 5:
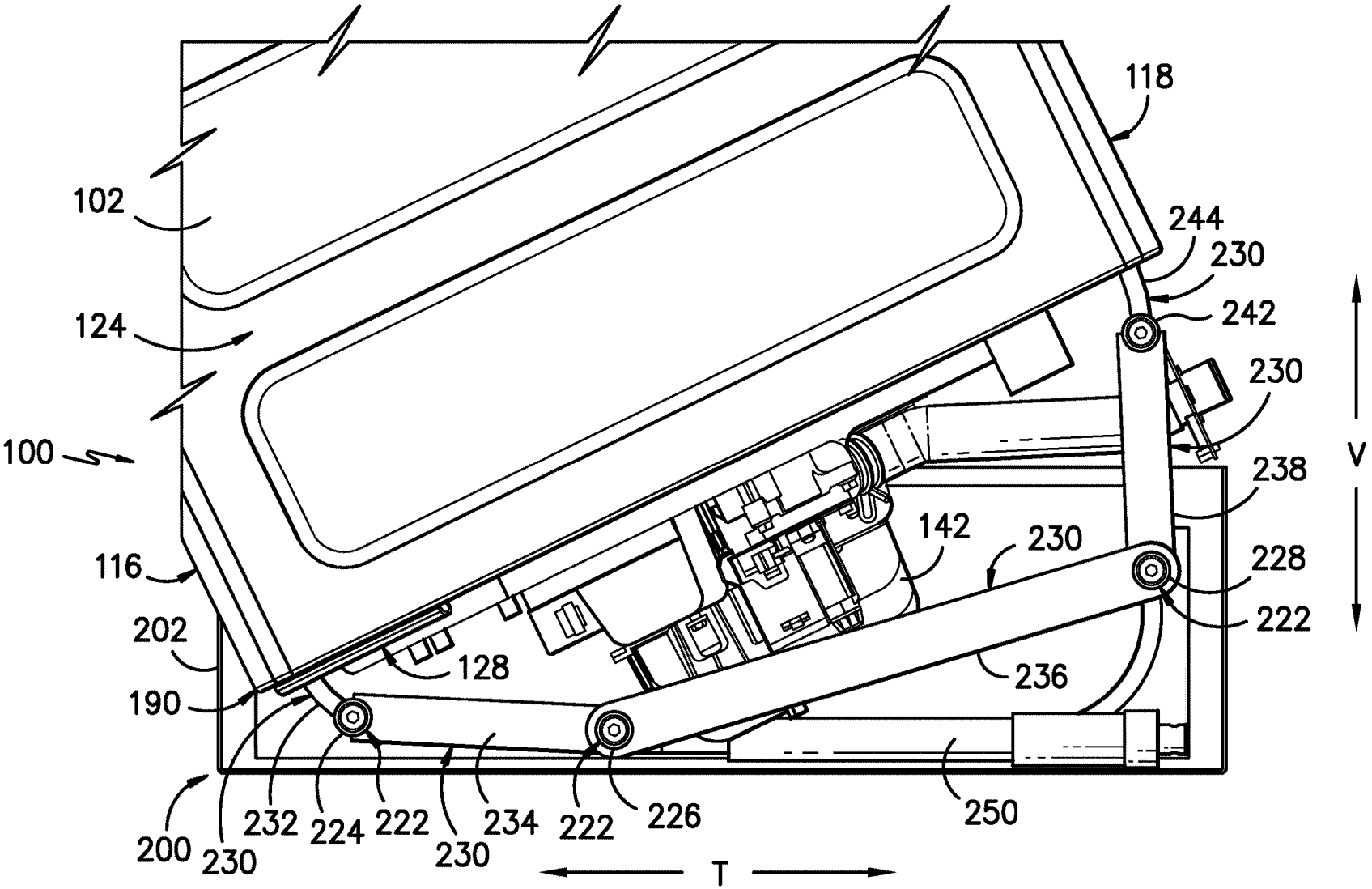
FIG. 5 provides a side, cross sectional view of the exemplary washing machine appliance of FIG. 3 in a loading position according to exemplary embodiments of the present disclosure.
Figure 6:
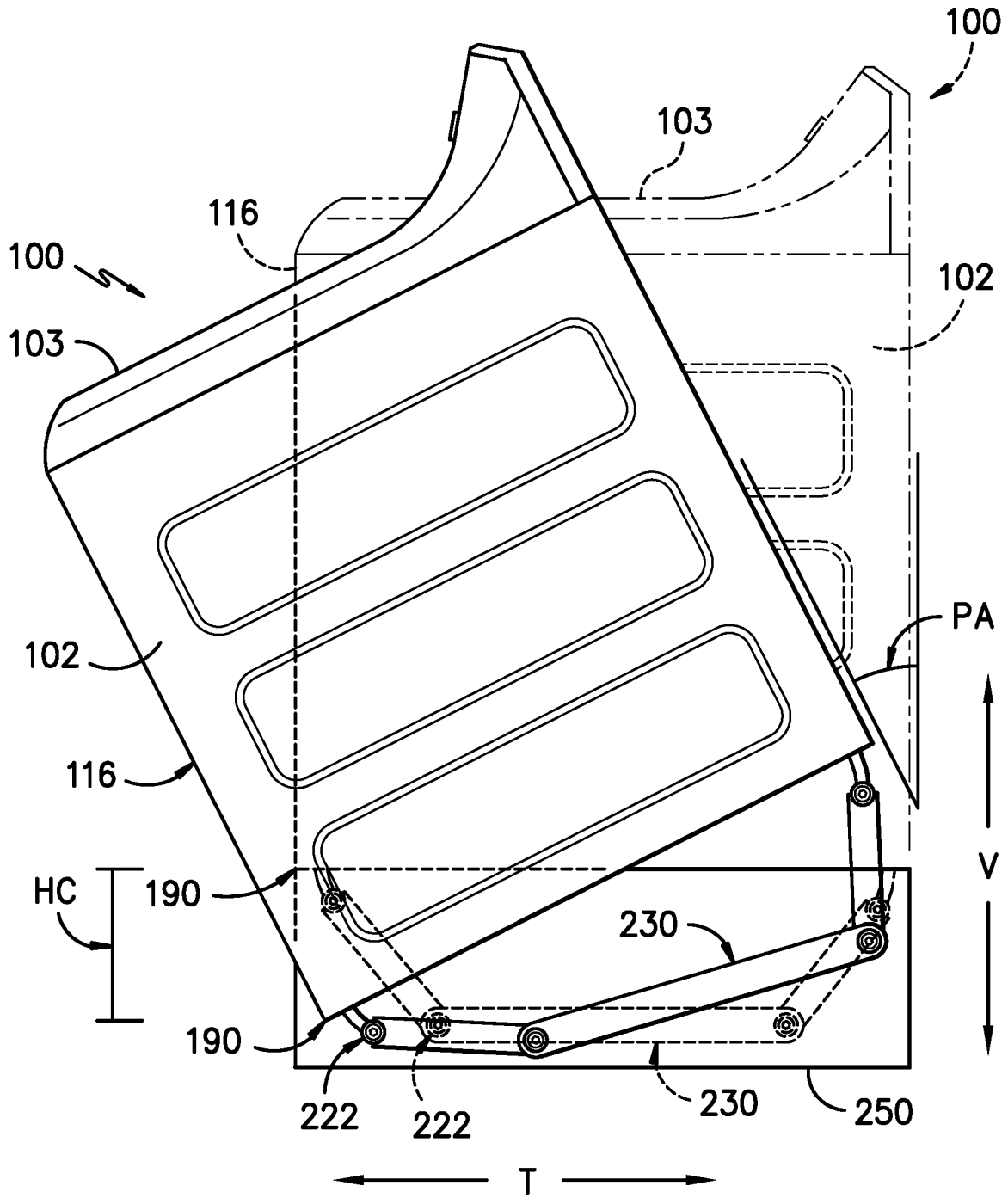
FIG. 6 provides a perspective view of an exemplary washing machine appliance in the loading position (solid lines) and in a washing position (dotted lines) according to exemplary embodiments of the present disclosure.

Turning to FIGS. 3 through 6, embodiments of an articulating stand assembly 200 are depicted, including stand assemblies attached to a washing machine appliance, such as that shown in FIGS. 1 and 2. FIGS. 3, 4, and the dotted line drawing of FIG. 6 depict the articulating stand assembly 200 and washing machine appliance 100 in a washing position. FIG. 5 and the solid line drawing of FIG. 6 depict articulating stand assembly 200 and washing machine appliance 100 in a loading position. Though specific mechanisms are described herein that couple stand assembly 200 to washing machine appliance 100, variations of the mechanisms described herein are understood to be within the scope of the present subject matter. Washing machine appliance 100 is shown herein as a top loading washing machine, as an example. Other embodiments of a washing machine appliance may also be used in embodiments, such as a front loading washing machine, a dryer appliance, or another household appliance to improve accessibility. Generally, the stand assembly 200 may be used with any household appliance having a cabinet and an opening where rotation forward from an upright position (e.g., the washing position) would aid a user in accessing the opening of the cabinet.

In some embodiments, stand assembly 200 may be integrated with appliance 100. In some embodiments, stand assembly 200 may be a retrofit or after market assembly, additive to a washing machine appliance 100. In some embodiments, stand assembly 200 may be a conversion piece, converting an existing appliance 100 to an appliance 100 moveable between the washing position and the loading position.

Cabinet 102 is moveable between loading position and washing position. Washing position, as also shown in FIGS. 1 and 2, places cabinet 102 in an upright position. Top 103 of cabinet 102 extends in a plane substantially parallel to transverse direction T and lateral direction L in the washing position. Top 103 of cabinet 102 is rotated in the loading position with respect to the position of top 103 of cabinet 102 in the washing position. For example, top 103 in the loading position is rotated with respect to the vertical direction V. In some embodiments, top 103 may be rotated by an angle (e.g., an acute angle, or an angle less than about 90 degrees) from the washing position to the loading position. For example, as illustrated in FIG. 6, cabinet 102 is rotated through a pivot angle PA measured relative to the vertical direction. In some examples, pivot angle PA may be less than about 60 degrees. In some examples, pivot angle PA may be less than 45 degrees. In some examples, pivot angle PA may be between about 10 and 60 degrees. In some examples, pivot angle PA may be between about 20 degrees and about 40 degrees.

In addition, according to exemplary embodiments, a bottom front edge 190 of cabinet 102 may correspondingly be lowered along transverse direction T or vertical direction V into stand assembly 200 in the loading position. For example, as illustrated in FIG. 6, cabinet 102 is rotated and translated such that movement from the washing position to the loading position results in front edge 190 traversing a height HC measured along the vertical direction V. According to exemplary embodiments, height HC is substantially equivalent to a height of the stand 202 (described below).

Stand assembly 200 is generally configured for pivoting cabinet 102 into the loading position or the washing position. As shown, stand assembly 200 may be integral to washing machine 100. In some embodiments, stand assembly 200 may be separate or removable from washing machine 100. In some embodiments, stand assembly 200 is located below bottom 104 of cabinet 102. Stand assembly 200 may be located below frame 126. In some embodiments, stand assembly 200 attaches to washing machine appliance 100 at cabinet 102 or at frame 126. Additionally or alternatively, stand assembly 200 may attach to appliance 100 at base frame member 128. Generally, stand assembly 200 may attach to frame 126, cabinet 102 or any other suitable support of appliance 100. According to the arrangement, stand assembly 200 is located below wash basket 120 and wash tub 121 in vertical direction V.

Stand assembly 200 may include a stand 202. The stand 202 may have two opposing sides 218, 220. As shown in FIGS. 3 and 4, stand 202 may define a guide track 203. Guide track 203 may be a single track. In some embodiments, a plurality of guide tracks 203 are located on opposing sides 218, 220, for example, as shown in FIGS. 3 and 4. In some embodiments, guide track 203 may be internal to stand assembly 200 (not shown). In this regard, for example, opposing sides 218, 220 may include solid outer surfaces but may define guide track 203 on or in an internal surface. Stand 202 may attach to cabinet 102, as shown, or may be integral with cabinet 102 (not shown) in some embodiments. In certain embodiments, stand 202 may be contained within cabinet 102.

At least one of opposing sides 218, 220 of stand 202 define guide track 203. Guide track 203 may extend through opposing side 218 or 220 of stand 202, allowing a plurality of follower pins 222 (e.g., a first follower pin 224, a second follower pin 226, or a third follower pin 228) to be slidably received in guide track 203, as will be described in more detail below. A portion of guide track 203 extends along transverse direction T. In some embodiments, a portion of guide track 203 also extends along vertical direction V. Generally, follower pins 222 may slidably move within guide track 203 to move appliance 100 between the washing position and the loading position.

In some embodiments, guide track 203 may limit or guide movement of the washing machine appliance 100, including stand assembly 200 between the washing position and the loading position. Guide track 203 may include a forward guide track 204 or a rear guide track 206. In this regard, for example, ends of guide track 203 may be designed and configured for preventing further translation or rotation of cabinet 102 after the washing position or after the loading position is reached. Advantageously, this may provide stability of cabinet 102 in each position, (i.e., the loading position or the washing position).

Guide track 203 may include a transverse leg 208, a vertical leg 210, and a curved portion 212. Vertical leg 210 generally extends in vertical direction V. Transverse leg 208 generally extends in transverse direction T. Curved portion 212 may connect vertical leg 210 to transverse leg 208. A first follower pin 224 may be moveable between vertical leg 210 and transverse leg 208 by moving through curved portion 212. Though shown as extending in one direction, portions of guide track 203 may extend in other directions, such as a track directed in a direction with components in the vertical direction and the transverse direction.

In some embodiments, guide track 203 includes a forward guide track 204 (as shown in FIGS. 3 and 4). As shown, the stand 202 may further include rear guide track 206. Rear guide track 206 may be located parallel to forward guide track 204 in transverse direction T. Rear guide track 206 may further be located behind forward guide track 204 in transverse direction T. For example, rear guide track 206 may be proximate to rear panel 118 of cabinet 102 as compared to forward guide track 204.

Additionally or alternatively, rear guide track 206 may include a rear vertical end 214 located at a vertical high point of rear guide track 206. Rear guide track 206 may further include a rear transverse end 216 located at a transverse point of rear guide track 206. In some embodiments, rear guide track 206 may similarly have a rear curved portion 252, a rear transverse leg 254, and a rear vertical leg 256, the rear transverse end 216 located at an end of rear transverse leg 254, and the rear vertical end 214 located at an end of the rear vertical leg 256.

In some embodiments, forward guide track 204 or rear guide track 206 may limit movement of appliance 100, halting movement of the appliance 100 from rotating forward beyond the loading position. In certain embodiments, endpoints of guide track 203 (e.g., forward guide track 204 or rear guide track 206) indicate or limit movement of appliance 100 or stand assembly 202 to movement between the loading position and the washing position. For example, a third follower pin 228 may be constrained, positioned at the rear transverse end 216 in the washing position, as shown in FIG. 4. Third follower pin 228 may be constrained, positioned at the rear vertical end 214 in the loading position. In some embodiments, ends of guide track 203 may serve as a secondary safety feature, arresting movement of washing machine appliance 100 as it moves into the loading position, preventing movement of the washing machine appliance 100 from rotating forward beyond the position specified by guide track 203. For example, forward guide track 204 may have a first end 258 and a second end 260, and second end 260 of forward guide track 204 may be designed and configured for preventing further translation or rotation of cabinet 102 after the loading position is reached by limiting further movement of second follower pin 226 in transverse direction T.

Embodiments envisioned herein may include one or more guide tracks 203. In some embodiments, forward guide track 204 may extend along transverse direction, connecting with rear guide track 206 and forming a combined guide track (not shown). In some embodiments, each follower pin (e.g., follower pins 224, 226, 228) in the plurality of follower pins 222 may be slidably received in a corresponding guide track 203. Guide tracks 203 may be defined on one or both opposing sides 218, 220 of stand 202.

As shown, stand assembly 200 includes a plurality of follower pins 222 (e.g., first follower pin 224, a second follower pin 226, or third follower pin 228). Plurality of follower pins 222 may be slidably received in guide track 203 to move appliance 100 between the loading position and the washing position. The follower pins 222 may be mechanically coupled to cabinet 102. For example, follower pins 224, 226 and 228 may be received within guide track 203 on opposing side 218 or 220 of stand 202. In some embodiments, follower pins 222 are coupled to base frame 128 (e.g., by way of a plurality of linkages 230). Generally, follower pins 222 are mechanically coupled to washing machine appliance 100, either directly or indirectly, as shown or in an equivalent fashion. It is envisioned within embodiments herein that, though follower pins 222 are described as being slidably received within guide tracks 203, equivalent mechanisms may be used such as rollers received rotatably within guide tracks 203, or a reverse configuration, with follower pins 222 located along a panel of stand 202 and guide tracks 203 located internal to stand 202. Additionally or alternatively, though follower pins 222 are described herein, equivalent mechanisms, including rollers, or other slidable members may be used according to embodiments described herein.

According to the arrangement, plurality of follower pins 222 (e.g., follower pins 224, 226 or 228) are pivotably connected to a plurality of linkage arms 230 (e.g., linkage arms 232, 234, 236, or 238). Generally, the follower pins 222 pivotably connect at least two of the plurality of linkage arms 230. For example, each follower pin in the plurality of follower pins 222 may pivotably connect two adjoining linkages in the plurality of linkage arms 230. As shown, follower pins 222 orient movement of at least two of the plurality of linkage arms 230 with the guide track 203. By pivotably connecting at least two linkages in the plurality of linkage arms 230, follower pins 222 may be mechanically coupled to appliance 100 (e.g., by coupling to base frame member 128, cabinet 102, or any other suitable structure of appliance 100).

Additionally or alternatively, the plurality of follower pins 222 may include first follower pin 224, second follower pin 226 or third follower pin 228. As shown, first follower pin 224 and second follower pin 226 may be slidably received in forward guide track 204 with third follower pin 228 slidably received in rear guide track 206.

Generally, stand assembly 200 includes a plurality of linkage arms 230. For example, as shown, plurality of linkage arms 230 may include a first linkage 232, a second linkage 234, a third linkage 236 or a fourth linkage 238. The plurality of linkage arms 230 are generally located within stand 202. The plurality of linkage arms 230 are further configured to mechanically couple to washing machine appliance 100. For example, base frame member 128 may directly couple with first linkage 232 or with rear linkage 2344 in some embodiments. In certain embodiments, first linkage 232 or rear linkage 244 may screw into a plurality of apertures of appliance 100 typically used to screw in a plurality of leveling feet that may be used along bottom 104 to level cabinet 102 of washing machine appliance 100. A portion of the linkages may replace the leveling feet in the plurality of apertures in some embodiments. In some embodiments, other pivotable connections may connect linkage arms to frame 126 or cabinet 102 of appliance 100. Though four linkages 230 are shown herein, more or less linkages 230 may be used in the plurality of linkage arms 230 in embodiments envisioned according to the arrangements described herein.

Plurality of linkage arms 230 generally align with the guide track 203 and plurality of follower pins 222 to move washing machine appliance 100 between the washing position and the loading position. According to the arrangement, first linkage 232 is configured to pivotably attach to washing machine appliance 100. Second linkage 234 is pivotably connected to first linkage 232 by first follower pin 224. Third linkage 236 is pivotably connected to second linkage 234 by second follower pin 226. Fourth linkage 238 is pivotably connected to third linkage 236 by third follower pin 228. Fourth linkage 238 is configured to pivotably connect to washing machine appliance 100. In some embodiments, fourth linkage 238 is configured to pivotably connect to washing machine appliance 100 at a position behind the connection of first linkage 232 to washing machine appliance 100 in transverse direction T. Additionally or alternatively, first linkage 232 may be connected to base frame 128. In certain embodiments, fourth linkage 238 may be connected to base frame 128 at a position behind the connection of first linkage 232 to base frame 128 in transverse direction T.

Optionally, and as shown in FIGS. 3 through 5, a pivotable connection 242 and a rear linkage 244 connect fourth linkage 238 to washing machine appliance 100 (e.g., to base frame 128). In some embodiments, pivotable connection 242 forms a pivotable connection similar to the pivotable connection formed by follower pins 224, 226, or 228. As shown, pivotable connection 242 pivotably connects rear linkage 244 to fourth linkage 238. Rear linkage 244 is configured to pivotably attach to washing machine appliance 100. As shown, pivotable connection 242 is not slidably received in guide track 203. In some embodiments, pivotable connection 242 is received within a shelf (not shown) in the loading position, anchoring washing machine appliance 100 and aiding in preventing further movement of the washing machine appliance 100 forward when washing machine appliance 100 is in the loading position.

As shown in FIGS. 3 and 4, in some embodiments, the plurality of linkage arms 230 may be a dual system, with a set or similar configuration of linkage arms 230 being proximate to each opposing side 218 and 220 of stand 202. In other words, there may be two sets of linkage arms 230 within stand assembly 200 in some embodiments. Further, some embodiments may include at least one guide track 203 on both opposing sides 218, 220 of stand 202 with two sets plurality of follower pins 222 slidably received into the guide tracks 203 on both opposing sides 218, 220. In some embodiments, at least one connecting bar (e.g., connecting bar 246) may connect sets of linkage arms 230 in lateral direction L. During use, sets of linkage arms 230 are coordinated during movement between the loading position and the washing position. In some embodiments, connecting bars may extend laterally between connections of linkages 230 at some or each of the plurality of follower pins 222. For example, as shown, connecting bar 246 extends between both first follower pins 224 (one first follower pin 224 shown in FIG. 3 and one corresponding opposing first follower pin 224 shown in FIG. 4), connecting both sets of first linkages 232 and second linkages 234, as shown in FIGS. 3 and 4. Connecting bars may aid in strengthening linkages 230 or follower pins 222 in their movement along guide tracks 203 between the loading position and the washing position. Though follower pins 222 and guide tracks 203 are shown on both opposing sides 218 and 220 of stand 202, embodiments are envisioned that include two sets of linkages 230, with only one opposing side of stand 202 (e.g., side 218) having a guide track 203 with follower pins 222, the other side coupled to the follower pins 222 (e.g., with connecting bars).

During use, the plurality of follower pins 222 are slidably received in the guide track 203 to move between the loading position and the washing position, the plurality of linkages 230 or the washing machine appliance 100 rigidly connected to the follower pins 222 and correspondingly moving into the loading position or the washing position with the movement of the follower pins 222.

In some embodiments, as previously detailed, first follower pin 224 and second follower pin 226 are received in forward guide track 204. In turn, second follower pin 226 slides along transverse leg 208 of forward guide track 204. Second follower pin 226 in the washing position is generally forward in transverse direction T of the position of second follower pin 226 in loading position, second follower pin 226 generally sliding within transverse leg 208 of forward guide track 204. First follower pin 224 may be moveable between vertical leg 210 through curved portion 212, and toward transverse leg 208 between the washing position and the loading position. For example, first follower pin 224 may be located at or near to an upward end of vertical leg 210 in the washing position. First follower pin 224 may move along vertical leg 210, into curved portion 212, and toward transverse leg 208 to move into the loading position. In some embodiments, first follower pin 224 may be in transverse leg 208 in the loading position. In certain embodiments, first follower pin 224 may be in the curved portion 212 of guide track 204, proximate to transverse leg 208 in the loading position.

In some embodiments, as previously detailed, third follower pin 228 is slidably received in rear guide track 206. In washing position, third follower pin 228 may be located at or proximate to rear transverse end 216 of rear guide track 206. As stand assembly 200 moves from the washing position to the loading position, third follower pin 228 may move in transverse direction T along rear guide track 206, through a rear curved portion, and into a vertical movement, third follower pin 228 moving toward rear vertical end 214 in the loading position. In some embodiments, third follower pin 228 may be at vertical end 214 of rear guide track 206 in the loading position.

In additional or alternative embodiments, stand assembly 200 may include an actuator or a resilient member (e.g., a piston 250). The actuator or resilient member may aid in movement of the stand assembly 200 or appliance 100 between the loading position and the washing position. Movement between the loading position and the washing position may be manually performed or electronically performed, depending on the embodiments. For example, as shown in FIG. 5, a piston 250 is a part of stand assembly 200. Though piston 250 is shown in FIG. 5, any actuator, including a linear actuator, piston, or equivalent structure may be used according to embodiments described herein. Piston 250 may be configured to motivate the plurality of linkage arms 230 (e.g., linkages 232, 234, 236, 238) and the plurality of follower pins 222 between the loading position and the washing position. In some embodiments, piston 250 may be electronically actuated, washing machine appliance 100 electronically moved between the loading position and the washing position.

In some embodiments, controller 108 may be operably connected to piston 250 to direct movement between the washing position and the loading position. Controller 108 may receive instructions from a user to move the appliance between the washing position and the loading position (e.g., by the user manipulating control panel 110). In the illustrated embodiments, piston 250 is coupled to second follower pin 226. For example, a connecting bar (e.g., connecting bar 246 or a similar connecting bar extending between a pair of opposing follower pins 222) may attach to piston 250 and to the pivot connection of second follower pin 226, second linkage 234, and third linkage 236. In some embodiments, piston 250 may connect to at least one linkage in the plurality of linkages 230 or may connect to at least one follower pin in the plurality of follower pins 222. As used herein, a connection or attachment includes direct or indirect connections or attachments, unless otherwise indicated.

As shown in FIG. 6, piston 250 is positioned proximate to rear 118. In some embodiments, piston 250 extends along transverse direction T between the loading position and the washing position. Piston 250 is configured to motivate the plurality of linkage arms 230 (e.g., linkages 232, 234, 236, 238) and the plurality of follower pins 222 (e.g., follower pins 224, 226, 228) between the loading position and the washing position. For example, piston 250 may be connected to second follower pin 226, moving second follower pin 226 in transverse direction T along guide track 203 between the washing position and the loading position. According to the arrangement, piston 250 may extend toward front panel 116 in the washing position and contract toward rear panel 118 in the loading position. Other equivalent configurations of piston 250 may also be used, including positioning the piston 250 proximate to front 116, instead of proximate to rear 118 as shown in FIGS. 5 and 6.

Additionally or alternatively, stand assembly 200 may include a resilient member (not shown) connected to the plurality of follower pins 222 (e.g., follower pins 224, 226, 228). For example, in place of piston 250, a resilient member may be used to aid in movement of appliance 100 between the loading position and the washing position. In some embodiments both a resilient member and an actuator may be used. In some embodiments, movement between the loading position and the washing position may be performed manually, for example, by a user manually shifting the appliance 100 into the loading position or the washing position. A resilient member may include a spring, an air compressed piston, a liquid compressed piston, or an equivalent member as known in the art. Advantageously, a resilient member or actuator may aid in dampening the movement of the appliance 100 between the loading position and the washing position. In some embodiments, the resilient member or actuator may aid in motivating the appliance 100 between the loading position and the washing position, reducing the force required to move the cabinet 102 between the loading position and the washing position than such movement would be without the resilient member or the actuator.

Embodiments described herein may relate to an articulating mechanism for a top load washing machine appliance. Embodiments may include a guide track and a follower mechanism slidably attached to the guide track with multiple linkages used to articulate the appliance. During use, loading and unloading the appliance may be tilted forward to provide easier access. Such may be particularly advantageous to deeper or larger washing machine appliances. The front edge (e.g., bottom front edge 190) of the washing machine appliance may be lowered and tipped into a loading position. Advantageously, such tipping may reduce the required user bending to load or unload the appliance. In some embodiments, guide track 203 and follower mechanism with multiple linkages 230 keep the appliance largely centered over the stand assembly while in the loading position. In certain embodiments, the appliance may articulate on the stand assembly, lowering the front edge (e.g., bottom front edge 190) by about 12 inches. In some embodiments, the front edge 190 may be lowered by between about 3 and about 15 inches. In certain embodiments, the front edge 190 may be lowered by between about 8 and about 14 inches.

Embodiments described herein may further relate to an articulating top load washing machine appliance. In order to increase capacity of top load washing machine appliances, the wash basket needs to be increased in either width or height. An increase the height of the wash basket may increase difficulty of accessing the entirety of the wash basket for loading or unloading the wash basket during use. Embodiments herein may ease unloading and loading of the washing machine appliance by articulating or tipping the appliance forward. A linkage mechanism attached to a frame of the appliance may be used to tilt the wash basket forward into a loading position. Lowering the front edge (e.g., bottom front edge 190) and tipping the unit (e.g., by angling it with respect to the vertical direction in the loading position as compared to the washing position), may reduce user required bending. Such reduction may be from about 180 degrees to closer to about 120 degrees.

Advantageously, embodiments described herein may operate in an upright position or the washing position with a larger capacity without decreasing accessibility of the user through the articulation or tipping of the appliance between the loading position and the washing position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance having a vertical direction, a transverse direction, and a lateral direction, the washing machine appliance comprising:

a cabinet defining an opening and moveable between a loading position and a washing position; and a stand assembly supporting the cabinet, the stand assembly comprising a stand defining a guide track that is at least partially curved, a plurality of linkage arms located within the stand, and a plurality of follower pins pivotably connecting the linkage arms, the follower pins mechanically coupled to the cabinet and translatably, slidably received into the guide track to move the cabinet between the loading position and the washing position.

2. The washing machine appliance of claim 1, wherein the cabinet comprises a top, a bottom front edge, and defines the opening at the top, and wherein the top of the cabinet rotated in the loading position with respect to a position of the top of the cabinet in the washing position, and wherein the top of the cabinet extends in a plane substantially parallel to the transverse direction and the lateral direction in the washing position.

3. The washing machine appliance of claim 1, wherein the plurality of follower pins pivotably connect at least two of the plurality of linkage arms, orienting movement of the at least two of the plurality of linkage arms with the guide track.

4. The washing machine appliance of claim 1 further comprising a base frame wherein the plurality of follower pins comprises a first follower pin, and wherein the plurality of linkage arms comprises a first linkage connected to the base frame, and a second linkage pivotably connected to the first linkage by the first follower pin.

5. The washing machine appliance of claim 4, wherein the first linkage pivotably attaches to the cabinet at the base frame.

6. The washing machine appliance of claim 4, wherein the guide track comprises a transverse leg extending along the transverse direction, a vertical leg extending along the vertical direction, and a curved portion, the curved portion connecting the vertical leg and the transverse leg, the first follower pin moveable between the vertical leg and the transverse leg by moving through the curved portion.

7. The washing machine appliance of claim 4, wherein the plurality of follower pins further comprises a second follower pin and a third follower pin, and wherein the plurality of linkage arms further comprises a third linkage pivotably connected to the second linkage by the second follower pin, and a fourth linkage pivotably connected to the third linkage by the third follower pin and pivotably connected to the base frame at position behind the connection of the first linkage to the base frame in the transverse direction.

8. The washing machine appliance of claim 7, wherein the guide track is a forward guide track, the stand further defines a rear guide track located parallel to the forward guide track in the lateral direction and behind the forward guide track in the transverse direction, and wherein the first follower pin and the second follower pin are slidably received in the forward guide track and the third follower pin is slidably received in the rear guide track.

9. The washing machine appliance of claim 7, wherein the second follower pin is slidably received in the guide track, and wherein the second follower pin slides along a transverse leg of the guide track between the washing position and the loading position, the second follower pin in the washing position being forward, in the transverse direction, of the second follower pin in the loading position within the transverse leg of the guide track.

10. The washing machine appliance of claim 7, further comprising a piston coupled to the second follower pin and extends along the transverse direction between the loading position and the washing position, the piston configured to motivate the plurality of linkage arms and the plurality of follower pins between the loading position and the washing position.

11. The washing machine appliance of claim 1, further comprising a piston connected to the plurality of linkage arms, the piston configured to motivate the plurality of linkage arms and the plurality of follower pins between the loading position and the washing position, the appliance electronically articulated between the loading position and the washing position.

12. The washing machine appliance of claim 1, further comprising a resilient member connected to the plurality of follower pins, wherein the washing machine appliance is manually shifted between the washing position and the loading position.

13. The washing machine appliance of claim 1, wherein the stand assembly is integrated with the cabinet.

14. The washing machine appliance of claim 1, wherein the stand assembly is removable from the cabinet.

15. An articulating stand assembly for supporting a washing machine appliance, the washing machine appliance comprising a cabinet, the washing machine appliance having a vertical direction, a transverse direction and a lateral direction, the stand assembly comprising:

a stand defining a guide track that is at least partially curved;

a plurality of linkage arms located within the stand and configured to mechanically couple to the washing machine appliance; and a plurality of follower pins pivotably connecting the linkage arms, the plurality of follower pins slidably received into the guide track to translate between a loading position and a washing position.

16. The stand assembly of claim 15, the stand comprising opposing sides, a front, and a rear, wherein the guide track is defined along at least one of the opposing sides, a portion of the guide track extending along the transverse direction.

17. The stand assembly of claim 15, wherein the plurality of follower pins comprises a first follower pin, a second follower pin, and a third follower pin, and wherein the plurality of linkage arms comprises a first linkage configured to connect to the washing machine appliance, a second linkage pivotably connected to the first linkage by the first follower pin, a third linkage pivotably connected to the second linkage by the second follower pin, and a fourth linkage pivotably connected to the third linkage by the third follower pin and configured to pivotably connect to the washing machine appliance at position behind the connection of the first linkage to the washing machine appliance in the transverse direction.

18. The stand assembly of claim 17, wherein the guide track comprises a transverse leg extending along the transverse direction, a vertical leg extending along the vertical direction, and a curved portion, the curved portion connecting the vertical leg and the transverse leg, the first follower pin moveable between the vertical leg and towards the transverse leg by moving through the curved portion, the second follower pin moveable along the transverse leg between the loading position and the washing position.

19. The stand assembly of claim 15, further comprising a linear actuator or a resilient member connected to the plurality of follower pins to aid in moving the stand assembly between the loading position and the washing position.

20. A washing machine appliance having a vertical direction, a transverse direction, and a lateral direction, the washing machine appliance comprising:

a cabinet having a top and defining an opening at the top; and a stand assembly comprising a stand having two opposing sides, at least one of the opposing sides defining a guide track that is at least partially curved, and a plurality of follower pins received in the guide track, the plurality of follower pins translatable within the guide track to permit movement of the appliance between a loading position and a washing position, wherein the top of the cabinet is rotated by an angle measured relative to the vertical direction in the loading position, and wherein the top of the cabinet extends in a plane substantially parallel to the transverse direction and the lateral direction in the washing position.

* * * * *